United States Patent [19]

Aidla

[11] 4,412,525

[45] Nov. 1, 1983

[54] HIGH EFFICIENCY FIREPLACE MODIFICATION

[76] Inventor: Harold Aidla, 4027-75 St., Edmonton, Alberta, Canada, T6K 0X2

[21] Appl. No.: 272,174

[22] Filed: Jun. 10, 1981

[51] Int. Cl.[3] ..... F24B 11/00

[52] U.S. Cl. ..... 126/140; 126/143; 126/202

[58] Field of Search ..... 126/120, 143, 135, 138, 126/140, 200, 202, 60–67, 77, 290, 193; 237/51

[56] References Cited

U.S. PATENT DOCUMENTS

| | | | |
|---|---|---|---|
| 453,765 | 6/1891 | Vance | 126/140 |
| 1,433,520 | 10/1922 | Aizpuru | 126/138 |
| 4,050,440 | 9/1977 | Lessin | 126/120 |
| 4,136,662 | 1/1979 | Willson | 126/61 |
| 4,213,443 | 7/1980 | Morande, Jr. | 126/61 |
| 4,249,510 | 2/1981 | Anderson | 126/123 |

*Primary Examiner*—Lee E. Barrett
*Attorney, Agent, or Firm*—Murray Schaffer

[57] ABSTRACT

A fireplace extension is provided, which extends forwardly from a traditonal fireplace, having two sets of doors, a first set of doors within the extension, and a second set of doors which close the extension. Fresh air duct means open into the fireplace extension between the first and second set of doors, and damper means are provided in the first set of doors, whereby, a surprising increase in efficiency in the fireplace itself is achieved, not only from the point of view of heat generated, but from the duration of time during which such fireplace is effective in generating heat.

1 Claim, 2 Drawing Figures

HIGH EFFICIENCY FIREPLACE MODIFICATION

This invention relates to a modification to standard fireplaces of the type having heat reclaiming systems known under such trade marks as HEATILATOR and the like.

The invention provides a fireplace structure which permits both higher heat output plus greatly extended burn times.

The invention is specifically directed to an extension projecting forwardly from a standard fireplace already equipped with warm air circulating apparatus as is well known to those skilled in the art.

The structure described hereinafter is adapted for easy installation to an existing fireplace, at relatively low cost.

The fireplace modification described herein may be finished with brick identical to or complementing the brick used in the fireplace itself, and thus be visually unobtrusive, and, in fact, attractive.

A principal object of the invention is to provide an extension extending unitarily forwardly of a fireplace comprising a pair of side walls and a top and bottom; a first set of doors within said extension; a second set of doors adapted to close said extension; a fresh air duct means opening into said extension between said first and second set of doors; and damper means in said first set of doors.

Figure 1:
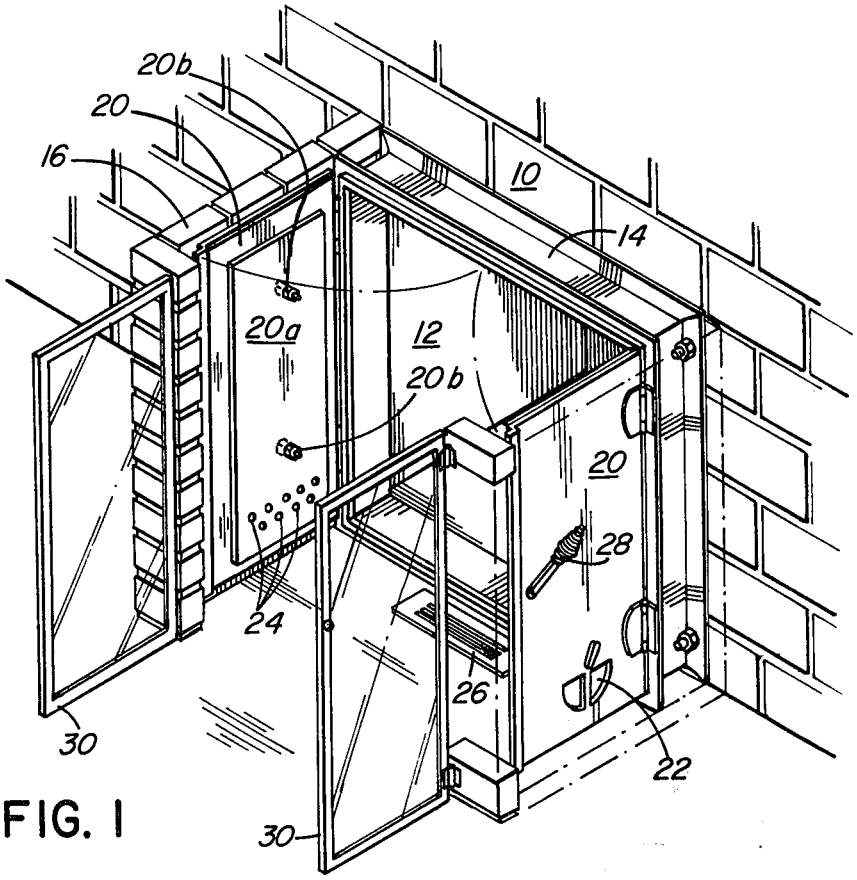
Figure 2:
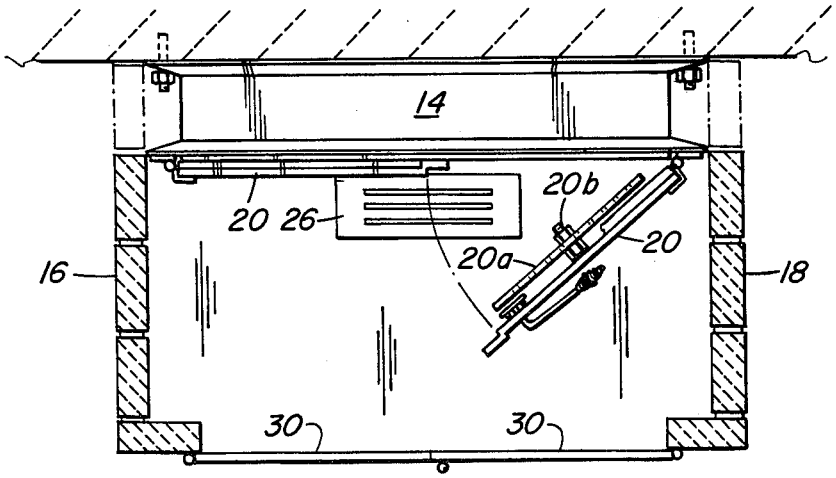

Reference will be made to the accompanying drawings in which:

FIG. 1 is a perspective view of the fireplace addition with portions broken away; and FIG. 2 is a top plan of the fireplace addition according to the invention, with elements omitted for purposes of simplicity.

Detailed reference will now be made to the drawings, wherein like reference numerals will identify like parts.

An existing fireplace 10 has a fireplace opening 12, fireplace 10 being provided with heat reclaiming apparatus, not illustrated, and is modified by attaching thereto a rectangular, metal U-shaped frame member 14 surrounding the top and both sides and bottom of fireplace opening 12, as shown in FIG. 1. A brick enclosure is partly illustrated in FIG. 1, comprising a side wall 16, and a facing side wall 18 is illustrated in FIG. 2. The extension is also provided with a top, not illustrated for purposes of simplicity.

A pair of inner doors 20 are hingedly mounted on frame 14 and are adapted effectively to close fireplace opening 12, doors 20 being double-walled, and as seen most clearly in FIG. 2 an inner panel **20*a* is spaced apart from the outer panel of door 20, by spacer and retainer nuts and bolts 20*b***.

Damper 22 in door 20 is seen in FIG. 1. A plurality of air holes 24 are provided on inner door panels **20*a*, whereby air flow into the fireplace opening 12** may be selectively controlled.

A fresh air inlet 26 is provided immediately in front of fireplace opening 12, and it will be appreciated that when doors 20 are securely closed, as by means of locking handle 28, that fresh air available from duct inlet 26 will be drawn through dampers 22 to the fireplace opening.

Outer doors 30, which as illustrated may include transparent panels, are adapted to completely seal the extension created by wall 16, 18, and the top thereof. The provision of transparent panels in outer doors 30 will permit viewing of a fire within fireplace opening 12, when desired, by leaving inner doors 20 in the open position illustrated in FIG. 1.

In operating a fireplace modified according to the invention described herein, some experimentation will be required on the part of the user, in order to determine the extent to which dampers 22 should be open. After short experimentation, however, it will be found that the efficiency of the fireplace modified as described will be dramatically increased.

Using equal quantities of identical fuel, it has been found that not only has the quantity of heat generated, but the duration of a fire has been improved as illustrated in the accompanying table.

In taking heat measurements, to obtain the results shown hereinafter, the fire box was pre-heated to 300° F. by burning small kindling. The fire was built by placing two six and a half inch diameter 16 inch long birch logs into the fire opening where temperature readings were taken every 15 minutes at the fire box, the chimney, and the heat reclaimer outlets.

The results of these burns are shown in the following table.

| | TIME IN HOURS | | | | | | | | | | | | | | |
|---|---|---|---|---|---|---|---|---|---|---|---|---|---|---|---|
| | 0 | ¼ | ½ | ¾ | 1 | 1¼ | 1½ | 1¾ | 2 | 2¼ | 2½ | 2¾ | 3 | 3¼ | 3½ |
| BOTH SETS OF DOORS OPEN | | | | | | | | | | | | | | | |
| Firebox | 400 | 360 | 310 | 265 | 240 | 220 | 200 | 190 | 180 | 165 | — | — | — | — | — |
| Reclaimer | 220 | 220 | 210 | 170 | 160 | 150 | — | — | — | — | — | — | — | — | — |
| Chimney | 490 | 400 | 320 | 270 | 250 | 230 | 210 | 200 | 190 | 175 | — | — | — | — | — |
| OUTER DOORS CLOSED | | | | | | | | | | | | | | | |
| Firebox | 320 | 325 | 300 | 260 | 240 | 210 | 190 | 180 | 170 | 160 | 150 | 140 | — | — | — |
| Reclaimer | 175 | 200 | 200 | 200 | 190 | 160 | 150 | 150 | 140 | 140 | — | — | — | — | — |
| Chimney | 465 | 440 | 380 | 330 | 270 | 260 | 260 | 250 | 220 | 200 | 185 | 170 | — | — | — |
| INNER DOORS CLOSED | | | | | | | | | | | | | | | |
| Firebox | 300 | 300 | 350 | 350 | — | 310 | — | 320 | — | 310 | — | 305 | — | 305 | — |
| Reclaimer | 185 | 180 | 190 | 185 | — | 175 | — | 170 | — | 165 | — | 165 | — | 160 | — |
| Chimney | 310 | 305 | 280 | 240 | — | 250 | — | 240 | — | 240 | — | 240 | — | 215 | — |
| BOTH SETS OF DOORS CLOSED | | | | | | | | | | | | | | | |
| Firebox | 380 | 430 | 450 | 460 | 470 | 470 | 440 | — | 425 | — | 420 | — | 395 | — | 390 |
| Reclaimer | 200 | 210 | 220 | 215 | 215 | 210 | 210 | — | 205 | — | 200 | — | 190 | — | 180 |
| Chimney | 285 | 290 | 290 | 280 | 220 | 220 | 220 | — | 220 | — | 210 | — | 210 | — | 210 |

| | TIME IN HOURS | | | | | | | | | | | |
|---|---|---|---|---|---|---|---|---|---|---|---|---|
| | 3¾ | 4 | 4¼ | 4½ | 4¾ | 5 | 5¼ | 5½ | 5¾ | 6 | 6½ | 7 | 7½ |
| BOTH SETS OF DOORS OPEN | | | | | | | | | | | | | |
| Firebox | — | — | — | — | — | — | — | — | — | — | — | | |

-continued

| | | | | | | | | | | | | | |
|---|---|---|---|---|---|---|---|---|---|---|---|---|---|
| Reclaimer | — | — | — | — | — | — | — | — | — | — | — | | |
| Chimney | — | — | — | — | — | — | — | — | — | — | — | | |
| OUTER DOORS CLOSED | | | | | | | | | | | | | |
| Firebox | — | — | — | — | — | — | — | — | — | — | — | | |
| Reclaimer | — | — | — | — | — | — | — | — | — | — | — | | |
| Chimney | — | — | — | — | — | — | — | — | — | — | — | | |
| INNER DOORS CLOSED | | | | | | | | | | | | | |
| Firebox | 300 | — | 300 | — | 250 | — | 200 | 180 | 150 | — | — | | |
| Reclaimer | 165 | — | 160 | — | 150 | — | — | — | — | — | — | | |
| Chimney | 215 | — | 200 | — | 180 | — | 160 | — | — | — | — | | |
| BOTH SETS OF DOORS CLOSED | | | | | | | | | | | | | |
| Firebox | — | 340 | — | 340 | — | 285 | — | 250 | — | 210 | 185 | 175 | 155 |
| Reclaimer | — | 175 | — | 165 | — | 160 | — | 155 | — | 145 | — | — | — |
| Chimney | — | 190 | — | 180 | — | 170 | — | 165 | — | 160 | 150 | — | — |

It will be seen that with both of the fireplace extension doors closed a dramatic increase in temperature output and in duration of burn were achieved. It is significant that the duration of the burn achieved with both sets of doors closed extended the useful heat output by one and three quarters (1-$\frac{3}{4}$) of an hour, with heat produced through the fireplace firebox ductwork being at significantly higher temperatures than the output when only the inner doors were closed.

It is not possible to explain all of the reasons for the dramatic improvement in fireplace efficiency using the modification described herein. Part of the reason is obviously because of air pre-heating within the extension, as fresh air flows from vent 26, and then through damper 20, to within the space between interior door panels 20 and 20*a*, before entering the fireplace opening. This explanation in itself does not account for the very significant improvement in the fireplace performance.

It will be evident to those skilled in the art that the relatively low cost of an extension to a standard fireplace as described in the light of increasing fuel costs and the results achieved represent a significant advance in the fireplace art.

The structure described herein is by way of example and it will be evident that, for example, the bricks illustrated may be replaced by other building materials, and the invention should be limited only by the scope of the appended claims.

The embodiments of the invention in which an exclusive property or privilege is claimed are defined as follows:

1. Apparatus for improving the function of a fireplace having a front wall and an opening therein, comprising a unitary box-like extension comprising a pair of side walls and a top wall and bottom, said extension extending forwardly of said front wall of said fireplace and having its rear edges sealed with the front wall of said fireplace to surround the opening therein, a first set of impervious doors with said extension, hinged to the walls of said extension adjacent the opening of said fireplace and adapted to close the same, a second set of impervious doors spaced forwardly of said first set of doors to close said extension; a fresh air duct means opening into said extension between said first and second sets of doors; and variable damper means in said first set of doors to permit flow of air from said fresh air duct through said first set of doors into said opening.

* * * * *